United States Patent [19]

Mohs et al.

[11] 4,202,464

[45] May 13, 1980

[54] RECLOSEABLE CONTAINER

[75] Inventors: Thomas J. Mohs; Richard C. Engel, Jr., both of Madison, Wis.

[73] Assignee: Placon Corporation, Madison, Wis.

[21] Appl. No.: 880,215

[22] Filed: Feb. 22, 1978

[51] Int. Cl.[2] ..... B65D 51/00

[52] U.S. Cl. ..... 220/339; 206/634; 229/2.5 R; 206/515

[58] Field of Search ..... 206/470, 491, 634, 315, 206/525, 527, 459; 220/257, 339, 337, 352, 307, 306; 229/43, 2.5 R, 44 CB

[56] References Cited

U.S. PATENT DOCUMENTS

| | | | |
|---|---|---|---|
| 1,695,286 | 12/1928 | Johnson | 220/257 |
| 2,138,241 | 11/1938 | Koch et al. | 206/491 |
| 2,202,279 | 5/1940 | Wilson | 229/44 CB |
| 3,082,903 | 3/1963 | Stevens et al. | 220/339 |
| 3,344,974 | 10/1967 | Bostrom | 220/257 |
| 3,397,774 | 8/1968 | Tjaden | 220/352 |
| 3,580,485 | 5/1971 | Hall | 229/43 |
| 3,670,952 | 6/1972 | Venuti et al. | 206/515 |

*Primary Examiner*—William T. Dixson, Jr.

*Attorney, Agent, or Firm*—Isaksen, Lathrop, Esch, Hart & Clark

[57] ABSTRACT

A unitary nestable reclosable container is formed from a thin-walled clear flexible plastic or the like and includes a box-like base forming a receptacle for screws, bolts, etc. A lid is integrally joined to the base by a hinge and includes a peripheral groove having walls releasably engaging substantially planar side walls of the base for providing a sturdy closure. The peripheral groove further provides a wall which releasably locks with an upper portion of the base end wall providing a specially designed reversed taper spaced from a lower end wall portion by a restraining shelf. Each side juncture between the lid and base is substantially within a plane provided by the side wall while a label placed across such juncture forms a reliable seal. The side walls and end walls have specially designed pre-established angular orientations with respect to the bottom portion so that a plurality of similarly constructed containers may be nested in a stack while further allowing each individual container to be placed in an upstanding position supported by the end wall and integral hinge.

9 Claims, 8 Drawing Figures

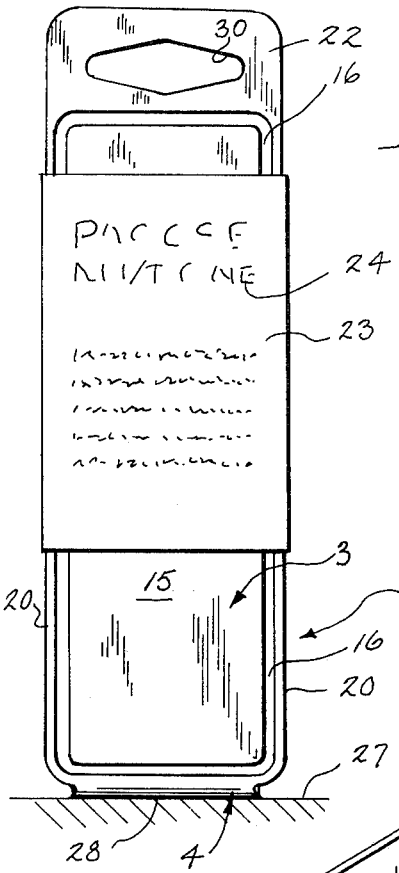
Fig.5
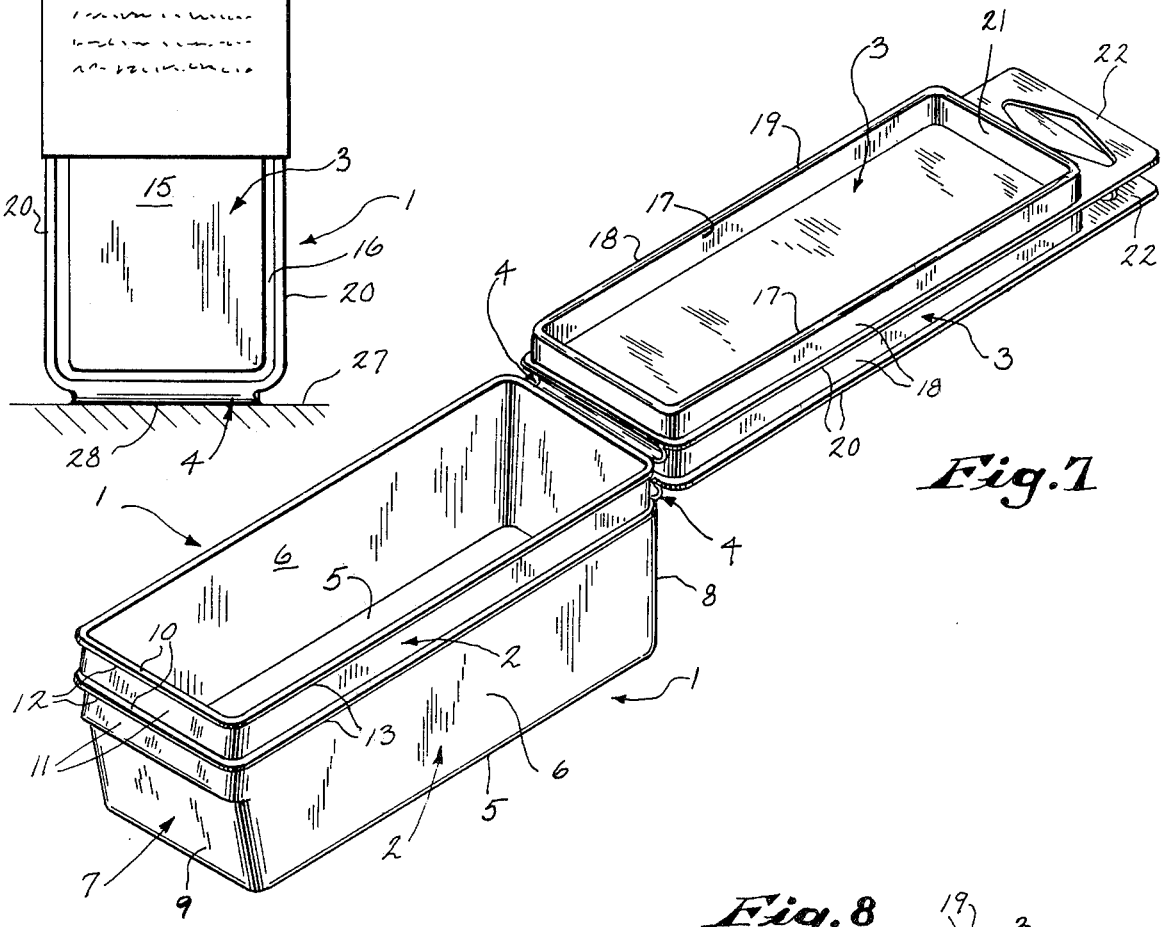
Fig.7
Fig.8
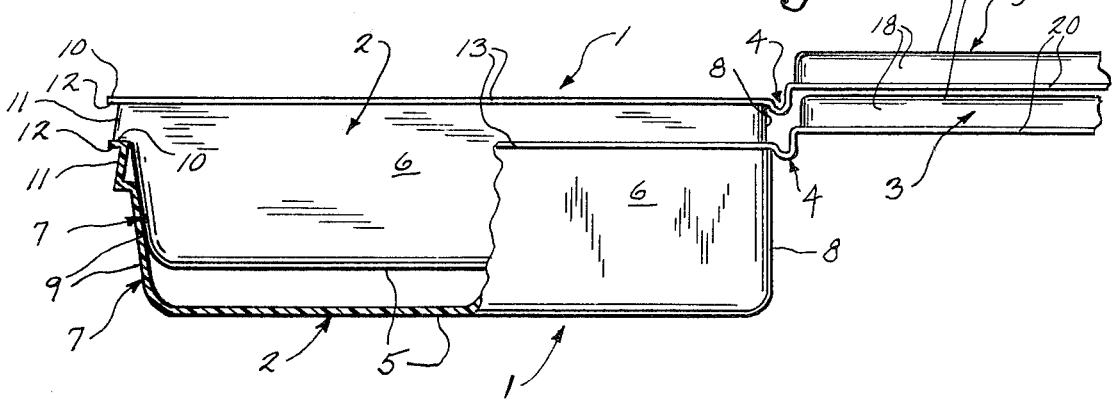

RECLOSEABLE CONTAINER

PRIOR ART OF INTEREST

U.S. Patents

| U.S. Pat. No. | Inventor | Issue Date |
|---|---|---|
| 1,105,710 | Stewart | August 4, 1914 |
| 2,713,845 | Silverman | July 26, 1955 |
| 2,736,656 | Marshall | February 28, 1956 |
| 2,845,104 | Frankel | July 29, 1958 |
| 2,873,782 | Gunn | February 17, 1959 |
| 2,885,135 | Friday | May 5, 1959 |
| 3,082,903 | Stevens et al | March 26, 1963 |
| 3,397,774 | Tjaden | August 20, 1968 |
| 3,556,337 | Harmon et al | January 19, 1971 |
| 3,576,271 | Seeley | April 27, 1971 |
| 3,655,111 | Surerus | April 11, 1972 |
| 3,710,975 | Jansen | January 16, 1973 |
| 3,937,389 | Wind | February 10, 1976 |

Foreign Patents

| | | |
|---|---|---|
| Germany | 372,038 | March 23, 1923 |

BACKGROUND OF THE INVENTION

This invention relates to a reclosable container, and more particularly to a container for use in displaying merchandise and storing small objects such as screws, nuts, bolts, brads, fishing lures, small electrical items, costume jewelry, craft or hobby supplies and the like.

One known proposal for fabricating such containers suggests their manufacture from flexible plastic to form a box-like structure with a lid integrally joined to the box by a hinge, such as illustrated in the Stevens et al patent. Such proposal, however, provides for exceptional outwardly directing mating flanges provided by both the box and the lid with the container front wall, end wall and side walls formed of an irregular shape each featuring an intermediate shelf. Such construction is highly undesirable where a label is required for sealing the junction between the container base and the lid because of the extreme distance of such remotely located outer junction extremity from the lower base side wall resulting in a likelihood of accidental damage to an applied label particularly adjacent the junction. Furthermore, such extreme outwardly directed mating flanges are believed to be of a substantial detriment if the closed container is to be stood in an upright position for display by supporting the container on its integral hinge and rear end wall.

SUMMARY OF THE INVENTION

The present invention solves the aforementioned and other problems of the prior art, and provides an improved reclosable container for small articles and the like. As in some previous constructions, the container comprises a thin-walled body of flexible plastic or the like, with a base forming a receptacle for any desired items together with a lid joined to the base by an integral hinge.

In accordance with one aspect of the invention, the base side walls are generally flat. A peripheral inwardly extending strengthening well or groove is formed in the lid surface and closely adjacent the lid edges. This groove is generally V-shaped and includes an inner wall and an outer wall. When the lid is closed, the outer groove wall serves to engage and support the inner surface of the upper edge portions of the base side-walls. The outer groove wall provides means supporting the planar and flexible base side-walls against bending for a sturdy construction in spite of the inherent flexibility of the thin-walled plastic.

A label secured over the lid and sides of the container covers the top of the peripheral groove and also lockingly seals the lid to the base. One desirable method of breaking the seal is to insert a knife, fingernail or other sharp instrument into the groove and move it therealong in a line to sever the label. The groove provides opposed walls which serve as controlled guide means so that the label will be severed only where desired, leaving the central portion of the label intact. The outer groove wall thus serves not only to support the base side-walls, but also as a portion of the controlled guide means.

In accordance with another aspect of the invention, the base side wall edges are provided with narrow beads or lips which mate with a very narrow flange on the lid which extends outwardly from the peripheral groove by onoy a very short distance. When the lid is closed, the mating elements project only minimally over the base side-walls so that the closed container sides are virtually planar. A label applied over the container will have an attractive appearance and not have to stretch across a side-edge gap which could subject a label to the danger of damage.

The peripheral lid groove functions with a specially designed front end wall of the container base to provide a desirable releaseable lock. Specifically, the front end wall of the container base remote from the hinge is tapered outwardly and outwardly and joins at its upper portion with an inner strengthening ledge. The wall above the ledge tapers slightly in an opposite direction, that is, upwardly and inwardly. The outer wall of the front end portion of the peripheral groove also tapers slightly upwardly and inwardly so that when the lid is inserted in the base, the groove wall mates with the upper portion of the base end wall to form a co-extensive lock which is biased tightly by the spring action of the hinge and the oppositely disposed groove outer wall.

The containers of thin flexible plastic material are specially constructed to nest in a stack for convenient shipping from the source of manufacture to distant locations where materials are placed therein. Specifically, one end wall is angularly orientated from the normal in an outward direction at an angle which is at least twice the angle of the outward angular orientation of the side-walls. Such construction permits a plurality of similarly constructed containers to be nested in a stack with the lids in an opened condition.

An end wall oppositely spaced from the angularly orientated and wall and adjacent the integral hinge is substantially normal to the bottom of the base. Such construction not only permits nesting of a plurality of containers in a highly desirable manner, but also allows each individual closed container even when filled to be placed in an upstanding position and supported upon the hinge and a portion of the end wall.

The lid end opposite the integral hinge provides an outward extension which protrudes beyond the box and provides means for releasably supporting the container in a hanging position.

BRIEF DESCRIPTION OF THE DRAWINGS

The accompanying drawings illustrate the best mode presently contemplated by the inventors for carrying out the invention.

In the drawings:

FIG. 5 is a front elevational view of the container of FIG. 2 upstanding upon a supporting surface for display purposes;

FIG. 7 is a perspective view of the reclosable container of FIG. 1 nested with another similarly constructed container to form a stack; and FIG. 8 is a side elevational view of the stack of FIG. 7 with a portion of the lower container broken away.

DESCRIPTION OF THE PREFERRED EMBODIMENT

Figure 1:
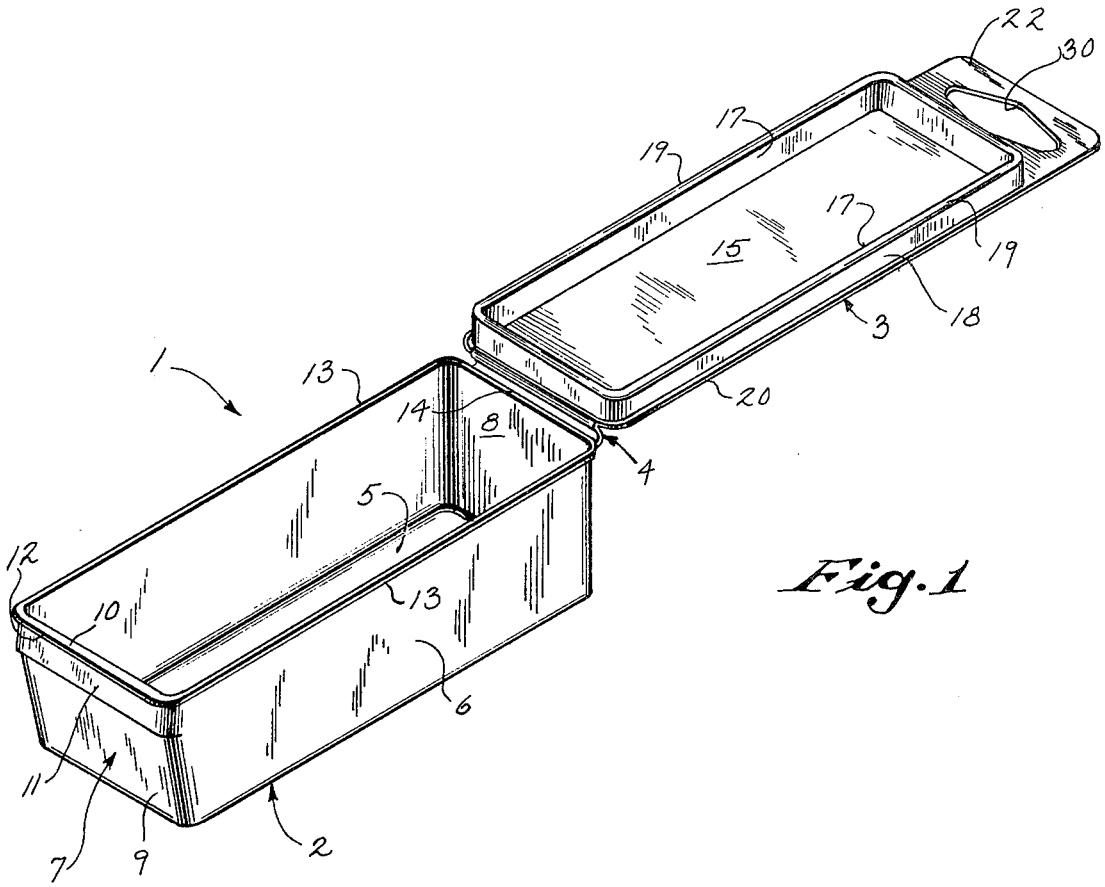
FIG. 1 is a perspective view of a reclosable container constructed in accordance with the invention, and with the lid integrally hinged with the base.

As shown in the drawings, the invention is directed to a container 1 having a base portion 2 and a lid portion 3 which are integrally joined by a hinge portion 4. Container 1 is preferably constructed of a thermoformed clear plastic having flexible walls of approximately 0.03" to 0.01" thickness. The relatively thin-wall construction requires careful design of the geometry of the container so that it will serve its intended purpose.

Base 2 comprises an elongated rectangular body having a flat bottom 5, a pair of planar side walls 6, and a front end wall 7 and rear end wall 8 which join the side walls. Rear wall 8 is shown as disposed at 90° from the plane containing the bottom 5, while side walls 6 taper outwardly in an upwardly direction at an approximate 5° degree angle from a plane which is normal to the plane containing the bottom 5.

Front wall 7 includes a lower wall portion 9 which tapers upwardly and outwardly at approximately 10° from a plane which is normal to the plane containing the bottom 5. Front wall 7 includes an outwardly extending shelf 10 which is intermediate an aupper wall portion 11 and the lower wall portion 9 with shelf 10 terminating adjacent the corners joining front wall 7 with side walls 6. The upper wall portion 11 extends from shelf 10 to the upper terminus of wall 7, the distance being approximately ¼ of the height of wall 7. Wall portion 11 has a reverse taper, that is, it tapers upwardly and inwardly at approximately 5° from the plane normal to bottom 5. Thus, the angle between the planes containing the lower wall 9 and the upper wall 11 is approximately 15°, and the approximate angular ratio of the respective walls 9 and 11 is 2 to 1. As in the case of shelf 10, upper wall portion 11 terminates adjacent the corners joinging wall 7 with walls 6. Wall portion 11 is co-extensive in length with shelf 10.

A horizontal flange 12 extends outwardly from the upper terminus of wall portion 11 of wall 7, for purposes to be described.

Base side walls 6, being planar and thin throughout, are flexible and subject to easy inward bending. The top edge of each wall 6 is provided with a bead-like lip 13 of minimal horizontal extent, for purposes to be described. Lips 13 are insufficient to strengthen walls 6 against sideways bending, and at their front ends join with flange 12 to form a planar top edge for base 2.

A lip 14, similar to lips 13, extends along the top edge of rear wall 8 and merges into "living hinge" 4, the other side of which joins to lid 3.

Lid 3 comprises a planar top portion 15, the side and rear edges of which are generally co-extensive with and adapted to sealingly mate with lips 13 and 14. Top portion 15 is provided with a peripheral strengthening generally V-shaped groove 16 which extends downwardly from the plane of the top and which is defined by an inner wall 17 and an outer wall 18 joined along the groove bottom, as at 19 to provide a lateral stiffening member for the lid and base. When lid 3 engages base 2 to form a closure, outer groove wall 18 snuggly fits within the top portions of side walls 6 and serves as means to support the wall against inward flexing. The aforementioned side and rear top edges of lid top 15 are formed by groove 16 into narrow flanges 20 which engage lips 13 and 14 when the cover is closed. The narrowness of lips 13 and flange 20 is such that the sides of the closed container are virtually planar.

The front end portion of outer wall 18 of groove 16 remote from hinge 4 is provided with a reverse taper at 21 which extends upwardly and inwardly and compliments and mates with the similarly tapered wall portion 11 of base 2. Thus, when lid 3 engages base 2 to form a closure, a snap-type locking action occurs to assist in holding the lid in place.

The front end portion of lid 3 comprises an extension of top 15 which engages end flange 12 and which also forms a pull-tab 22 for manually releasing lid 3 from base 2.

Figure 2:
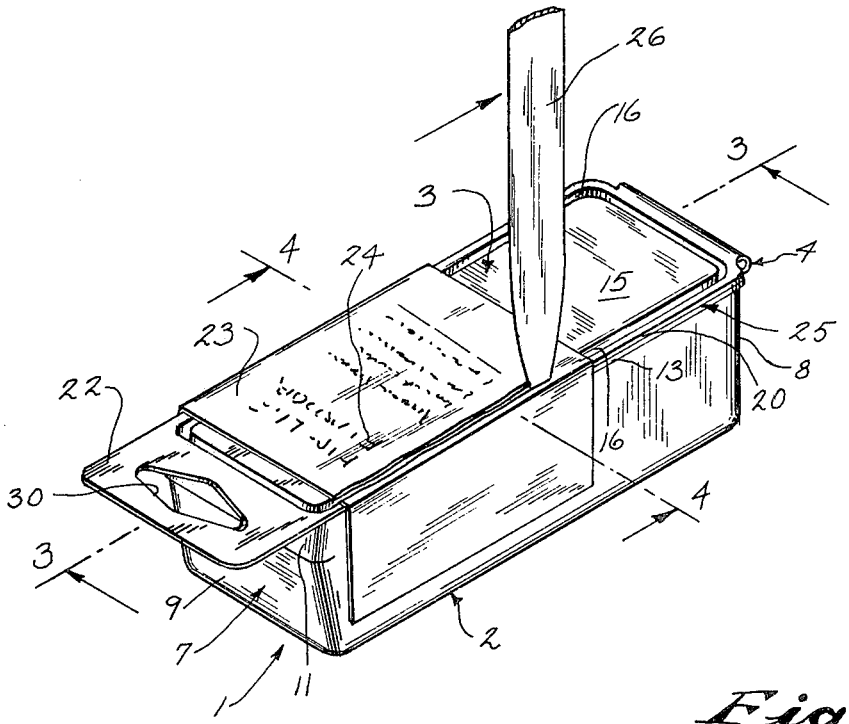
FIG. 2 is a perspective view of the container when closed and sealed with a label and showing one method of unsealing the lid.
Figure 3:
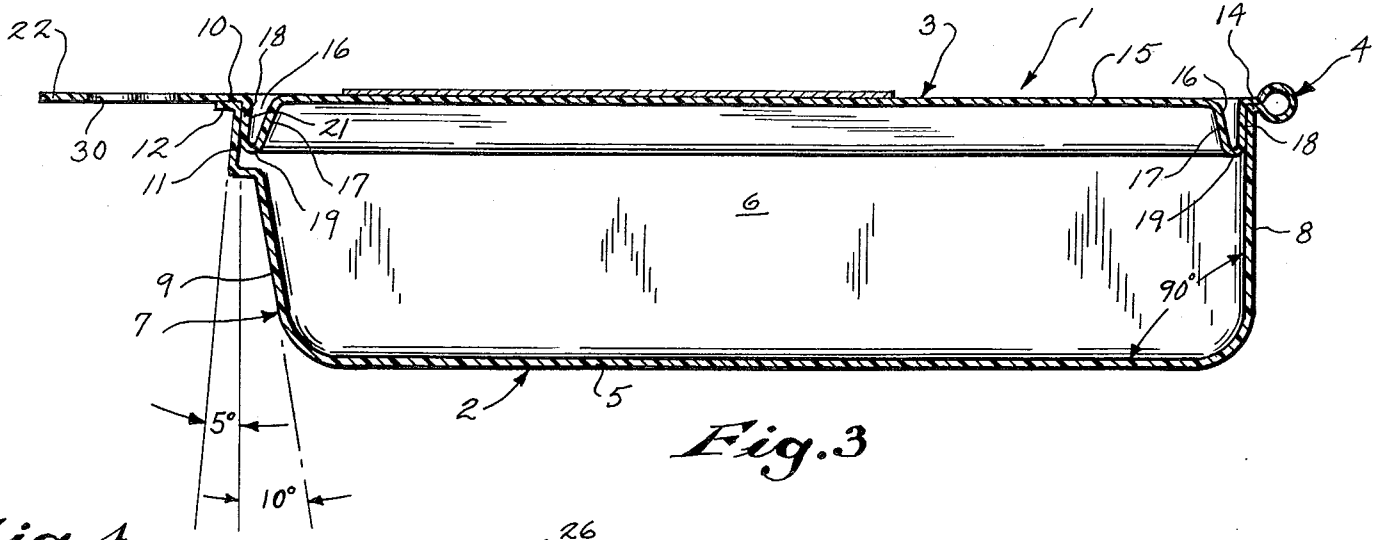
FIG. 3 is a central longitudinal section taken on line 3—3 of FIG. 2.

When container 1 is filled with material, such as small hardware items for example, it is frequently desirable to place printed material on the container for identification and pricing purposes. As shown in FIG. 2, an adhesive label 23 containing merchandise graphics, pricing information or other indicia 24 is placed over the lid 3 and extends over a portion of side walls 6 to maintain the container in a closed condition. The label may extend over most of the lid 3, but preferably only covers a portion of lid 3 with the remainder of the transparent lid providing a viewing area so that a prospective purchaser may see the merchandise. The provision of such viewing area is quite desirable when the container is placed on display in an upstanding position upon its end wall and integral hinge, as will be more fully described hereinafter.

Thus, the label 23 adheres to the surface 15 of lid 3 and bridges across groove 16. Of further importance, label 23 extends downwardly over the mating edges provided by the junctures 25 of lips 13 and flange 20 to lockingly seal them together and contact side walls 6. In that the junctions 25 and the side walls 6 are substantially within the same plane, the label 23 provides a highly desirable unitary seal with an attractive appearance which is not prone to accidental tearing through rough handling or fatigue.

The sealed container can be easily opened by severing the label 23 either at the junctures 25 or at the peripheral groove 16. Thus label 23 can be easily peripherally pierced by inserting a sharp instrument such as a knife 26 through a label above groove 16 and then traversing the knife through the groove peripherally around lid 3, thus severing the inner portion of the label from the outer portion. The inner groove wall 17 functions as an inner guide or barrier means to limit the inward lateral movement of knife 26. By so doing, the inner central portion of label 23 remains intact and its indicia 24 remains undamaged. Similarly, the outer groove wall 18 functions as an outer guide or barrier means to limit outward lateral knife movement. The lock formed by label 23 is thereby released by such severing and lid 3 may be pulled up by lifting tab 22.

Figure 6:
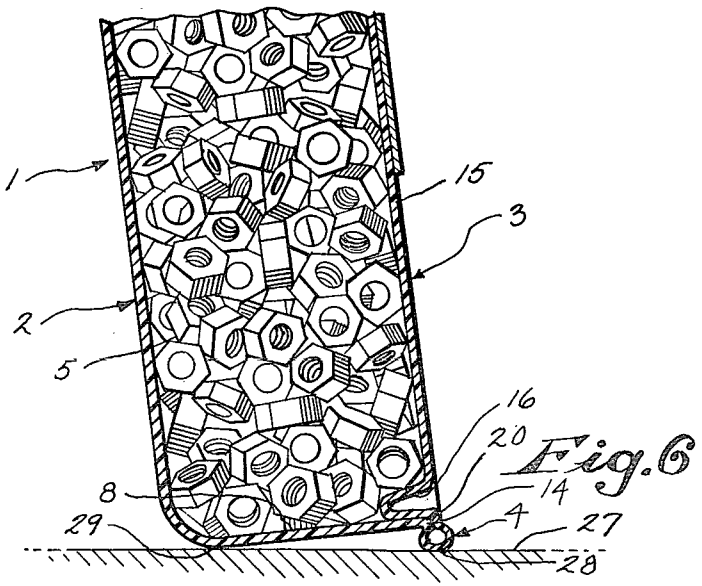
FIG. 6 is a fragmentary sectional view taken along line 6—6 in FIG. 5.
Figure 4:
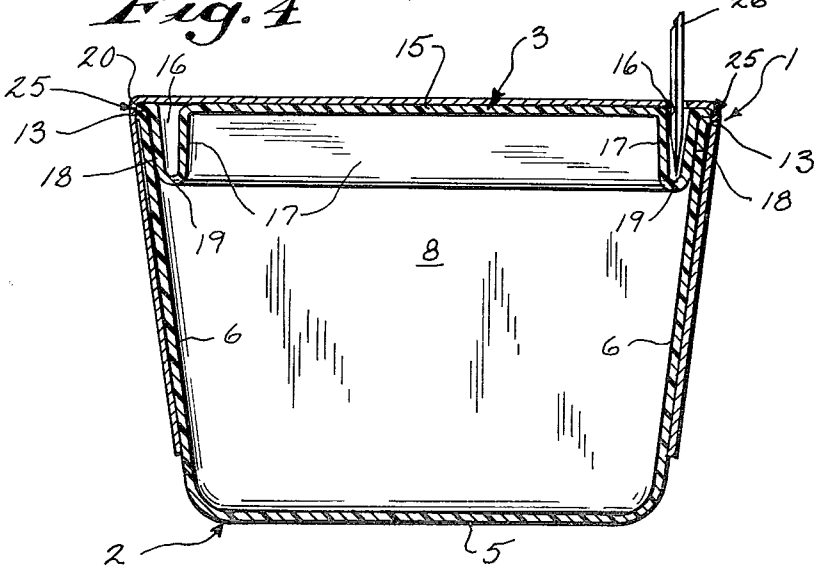
FIG. 4 is a transverse section taken on line 4—4 of FIG. 2.

FIGS. 5 and 6 illustrate container 1 in an upstanding position upon a supporting surface 27 such as a display table or counter top, for example. The integral hinge 4 includes an outer surface portion 28 which is spaced from the plane containing end wall 8. The end wall 8, which substantially lies in a plane normal to the plane containing bottom 5, includes a portion 29 at or adjacent the intersection of wall 8 to bottom 5. Both portion 29 of end wall 8 and portion 28 of hinge 4 extend substantially across the width of container 1 and provide means for contacting the supporting surface 27 to maintain container 1 in an upstanding position even when filled with heavy objects such as nuts or bolts.

The relatively small bead-like lip 14 together with the substantially normal end wall 8 permits a filled container 1 to be placed in a stable upstanding position while the particular angular orientation of side walls 6 and oppositely disposed end wall 7 permit convenient nesting of a plurality of unfilled containers 1 in a stack for storage or shipping.

As an alternative to positioning filled or unfilled containers 1 in either an upstanding or nested condition, the container 1 can be hung from a rod or spindle placed through a pre-formed opening 30 in the outward tab 22 provided by lid 3. When container 1 is supported in a hung condition, the releasable latch formed between the reverse taper 21 of wall 18 and the reverse taper 11 of end wall 7 provides a reasonably secure closure for container 1 even if label 23 has not been employed or has been severed or removed.

The nesting of empty containers is an important feature because a large number of unfilled containers such as 1 can be economically stored or shipped. Furthermore, stacked containers can be readily loaded into automatic denesting fixtures which form a part of modern automated packaging lines.

Various modes of carrying out the invention are contemplated as being within the scope of the following claims particularly pointing out and distinctly claiming the subject matter which is regarded as the invention.

We claim:

1. A reclosable container of thin flexible thermoformed plastic material comprising a rectangular container base having a generally flat bottom and planar sidewalls and front and rear end walls joining the sidewalls, a lid integrally hinged to the rear end wall and movable between open and closed positions to provide a top portion for closing and strengthening the container base, the lid having a peripheral generally V-shaped groove extending downwardly from the plane of the lid and defined by inner and outer walls joined along the bottom of the groove providing a lateral stiffening member for the lid and the container base, the outer groove wall being shaped and engaging the top inner portions of the sidewalls and end walls when the lid is in its closed position to support them against inward flexing and bending and provide a sturdy container construction, the lid having a horizontal flange in the plane of the lid overlying the top edges of the sidewalls without extending outward substantially beyond the plane of the sidewalls providing a junction with the sidewalls substantially within the plane of the sidewalls to permit a label to be applied to the lid and at least one sidewall without substantial separation of the label from the plane of the sidewall to lockingly seal the container.

2. The container of claim 1, wherein the top edges of the sidewalls are defined by bead-like lips of minimal horizontal extent substantially within the plane of the sidewalls.

3. The container of claim 1, wherein the upper portions of the groove walls are spaced to permit peripheral movement of a sharp instrument for peripherally severing the label.

4. The container of claim 1, wherein the front end wall includes a lower wall portion tapered upwardly and outwardly and an upper wall portion of reverse taper with a shelf joining the lower and upper wall portions.

5. The container of claim 4 wherein the lid outer groove wall extends forwardly adjacent to the front end wall to releasably engage the reverse taper upper wall portion of the front end wall when the lid is closed to form a releasable lock for the container.

6. The container of claim 4, wherein the taper of the lower wall portion is about ten degrees from the plane normal to the bottom, and the reverse taper of the upper wall portion is about five degrees from the plane normal to the bottom.

7. The container of claim 1, wherein the planar sidewalls are angularly orientated at a first angle in an outward direction with respect to a plane normal to the container base, the front end wall is angularly orientated at a second angle substantially greater than the first angle in an outward direction with respect to a plane normal to the container base and the rear end wall is substantially parallel to a plane normal to the container base for removably nesting the container with another container constructed in like manner.

8. The container of claim 1 wherein the lid includes a rear edge defined by the integral hinge connection of the lid to the upper edge of the rear end wall, the rear edge extending outwardly from the rear end wall when the lid is in its closed position to provide a mounting surface for the container when placed in an upstanding position supported by the mounting surface and a portion of the rear end wall adjacent a juncture between the base and the rear end wall.

9. The container of claim 1, wherein the lid includes a front edge releasably mating with an upper edge provided by the front end wall when the lid is in its closed position, the lid front edge including an outwardly extending projection providing means for supporting the container in a hanging position.

* * * * *